US008254817B2

(12) United States Patent
Kamijo et al.

(10) Patent No.: US 8,254,817 B2
(45) Date of Patent: Aug. 28, 2012

(54) TRANSFER DEVICE WITH ELECTRICALLY CONDUCTING ELASTIC MEMBER

(75) Inventors: Koichi Kamijo, Matsumoto (JP); Satoshi Chiba, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 281 days.

(21) Appl. No.: 12/707,054

(22) Filed: Feb. 17, 2010

(65) Prior Publication Data

US 2010/0226699 A1 Sep. 9, 2010

(30) Foreign Application Priority Data

Mar. 4, 2009 (JP) ..... 2009-050683

(51) Int. Cl.
*G03G 15/16* (2006.01)

(52) U.S. Cl. ..... 399/303

(58) Field of Classification Search ..... 399/303, 399/304

See application file for complete search history.

(56) References Cited

U.S. PATENT DOCUMENTS 5,745,829 A * 4/1998 Gazit et al. ..... 399/302
6,151,477 A * 11/2000 Takeuchi et al. ..... 399/318

FOREIGN PATENT DOCUMENTS

JP 03-004241 1/1991
JP 2000-508280 7/2000
WO 97/09262 3/1997

* cited by examiner

*Primary Examiner* — Quana M Grainger
(74) *Attorney, Agent, or Firm* — Workman Nydegger

(57) ABSTRACT

A transfer device includes: an electrically-conductive elastic member which carries a transfer material; a transfer material separating member which peels off the transfer material from the elastic member; a supporting member which has an elastic member supporting portion that supports the elastic member, and a separating member supporting portion that supports the transfer material separating member, and also, has electrically-conductive properties; and a transfer bias applying section which is electrically connected to the supporting member, thereby applying a transfer bias.

8 Claims, 11 Drawing Sheets

TRANSFER DEVICE WITH ELECTRICALLY CONDUCTING ELASTIC MEMBER

BACKGROUND

1. Technical Field

The present invention relates to a transfer device of an electrophotographic system and an image forming apparatus.

2. Related Art

There is proposed an image forming apparatus which develops a latent image of an image carrier by a developing device, thereby obtaining a visualized image and is provided with a transfer device that directly transfers a toner image on the image carrier to a transfer material such as paper. Also, there is proposed an image forming apparatus which visualizes a latent image of an image carrier by a developing device, thereby obtaining a visualized image, transfers a toner image on the image carrier to an intermediate transfer medium that is constituted of a belt tensioned around a plurality of rollers, or a drum, and is provided with a transfer device that transfers a toner image on the intermediate transfer medium to a transfer material.

In JP-A-3-4241, there is disclosed an image forming apparatus which develops a latent image on a photoconductor as an image carrier by a developing device, thereby obtaining a toner image and is provided with a transfer drum that transfers the toner image on the photoconductor to a transfer material. The transfer drum is provided with a gripper for gripping the transfer material, an electrifier for adsorption, which adheres the transfer material to the transfer drum by electrostatic adsorption, an electrifier for transfer, which is for transferring the toner image on the photoconductor to the transfer material, and an electrifier for separating, which is for separating the transfer material with the toner image transferred thereto, from the transfer drum.

In JP-T-2000-508280, there is disclosed an image forming apparatus which develops a latent image on a photoconductor by a liquid developer, thereby forming a toner image, transfers the toner image on the photoconductor to an intermediate transfer drum as an intermediate transfer medium, and is provided with a transfer drum that transfers the toner image of the intermediate transfer drum to a transfer material. The toner image on the intermediate transfer drum is transferred to the transfer material by heating and pressurizing. Also, the transfer drum is provided with a gripper that grips the transfer material. Also, a separating member that peels off the transfer material from the transfer drum is disposed outside the transfer drum.

But, in the image forming apparatus disclosed in JP-A-3-4241, it is necessary to dispose a plurality of electrifiers such as the electrifier for adsorption of the transfer material, the electrifier for transfer, and the electrifier for separating in the transfer drum, so that a configuration of the apparatus is complicated and control of each electrifier is also difficult. Also, in the image forming apparatus disclosed in JP-T-2000-508280, since the transfer of the toner image to the transfer material is thermal transfer by heating and pressurizing, the adhesion properties of the transfer material with the toner image transferred thereto to the transfer drum becomes stronger, so that there is a problem that the separating of the transfer material from the transfer drum becomes difficult.

SUMMARY

An advantage of some aspects of the invention is that it provides a transfer device which improves transfer properties of a toner image on an image carrier to a transfer material and ensures the separating of the transfer material with the toner image transferred thereto from a transfer roller, and an image forming apparatus provided with the transfer device.

According to a first aspect of the invention, there is provided a transfer device including: an electrically-conductive elastic member which supports a transfer material; a transfer material separating member which peels off the transfer material from the elastic member; a supporting member which has an elastic member supporting portion that supports the elastic member, and a separating member supporting portion that supports the transfer material separating member, and also, has electrically-conductive properties; and a transfer bias applying section which is electrically connected to the supporting member, thereby applying a transfer bias. Since an image is transferred in a state where the transfer material is adhered to the electrically-conductive elastic member by electrostatic adsorption by applying a transfer bias to the electrically-conductive supporting member, transfer properties are improved, and the transfer material with the image transferred thereto can be more reliably peeled off from the electrically-conductive elastic member by the transfer material separating member.

Also, the transfer device further includes: an electrically-conductive flange disposed at an end portion of the supporting member; and a connection portion which electrically connects the transfer bias applying section and the flange. Since an image is transferred in a state where the transfer material is adhered to the electrically-conductive elastic member by electrostatic adsorption by applying a transfer bias to the electrically-conductive supporting member through the flange, transfer properties are improved, and the transfer material with the image transferred thereto can be more reliably peeled off from the electrically-conductive elastic member by the transfer material separating member.

Also, in the transfer device, volume resistance of the elastic member is $1\times10^{6}$ to $1\times10^{11}\Omega$. It is possible to improve close contact properties of the transfer material with the transfer roller in a transfer section, thereby improving transfer properties.

Also, in the transfer device, the supporting member is a rotary circular cylinder member, the separating member supporting portion is constituted of a concave portion formed in the circular cylinder member, and the transfer material separating member is a projecting member which is projected from the concave portion. Since the transfer material separating member is located in the concave portion at times other than the time of the separating of transfer material, the transfer material separating member can be prevented from coming into contact with the transfer material during the transfer.

Also, in the transfer device, the transfer material separating member supporting portion and the elastic member supporting portion are constituted by an integral, electrically-conductive member, and also, the separating member supporting portion supports the transfer material separating member through an insulation material. It is possible to prevent electric discharge from the transfer material separating member at the time of the separating of the transfer material.

Also, according to a second aspect of the invention, there is provided an image forming apparatus including: an image carrier which supports a developed image; a transfer section which has an electrically-conductive elastic member that supports a transfer material, a transfer material separating member that peels off the transfer material from the elastic member, and a supporting member which has an elastic member supporting portion that supports the elastic member, and a separating member supporting portion that supports the transfer material separating member, and also, has electrically-conductive properties; a transfer bias applying section which is electrically connected to the supporting member, thereby applying a transfer bias; a transfer material transport section which transports the transfer material to which the image is transferred by the transfer section; and a fixing section which fixes the image transferred to the transfer material. It is possible to improve the transfer properties to the transfer material and peel properties of the transfer material.

Also, in the image forming apparatus, the image carrier is a belt member mounted in a tensioned state on belt mounting rollers. Also in a case where the image carrier is of a belt type, it is possible to improve transfer properties and peel properties of the transfer material.

Also, in the image forming apparatus, the image carrier is a rotary drum. Also in a case where the image carrier is of a drum type, it is possible to improve transfer properties and peel properties of the transfer material.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be explained with reference to the drawings.

Figure 1:
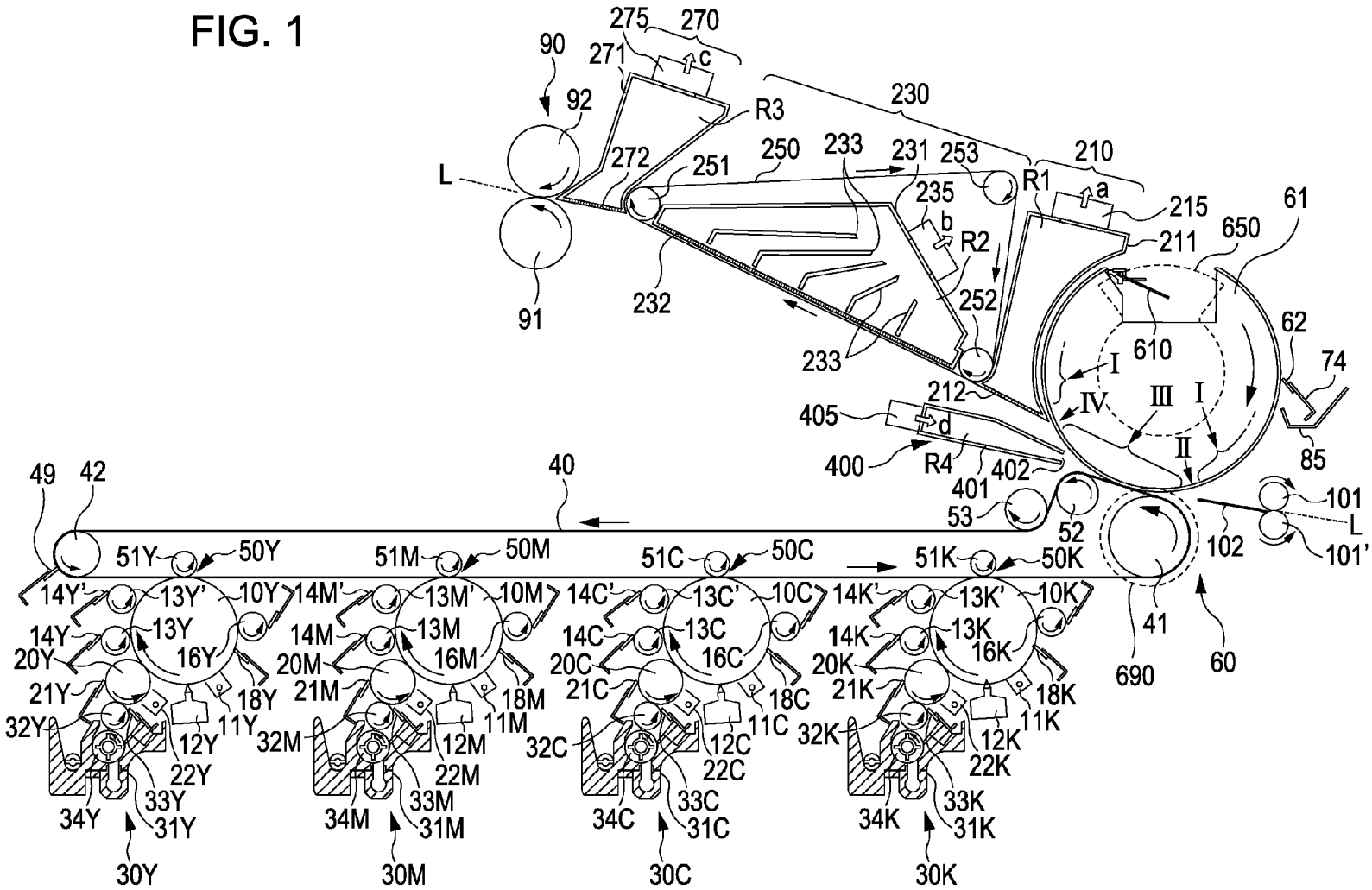
FIG. 1 is a view showing principal components constituting an image forming apparatus concerning an embodiment of the invention.

FIG. 1 is a view showing principal components constituting an image forming apparatus concerning an embodiment of the invention. With respect to an image forming section of each color, which is disposed at the central portion of the image forming apparatus, developing devices 30Y, 30M, 30C, and 30K are disposed at the lower portion of the image forming apparatus, and components such as a transfer belt 40, a secondary transfer section (secondary transfer unit) 60, and a fixing unit 90 are disposed at the upper portion of the image forming apparatus. In particular, due to a layout in which the fixing unit 90 is disposed above the transfer belt 40, the installation area of the whole image forming apparatus can be suppressed. In this embodiment, since a configuration is made such that a transfer material such as a paper, which has been subjected to secondary transfer at the secondary transfer unit 60, is transported to the fixing unit 90 while being sucked by a transfer material transporting device 230, suction devices 210 and 270, or the like, such layout can be realized.

The developing devices 30Y, 30M, 30C, and 30K are provided with photoconductors 10Y, 10M, 10C, and 10K, corona electrical charging devices 11Y, 11M, 11C, and 11K, exposure units 12Y, 12M, 12C, and 12K such as LED array, and so on in order to form an image by toner. By uniformly electrically charging the photoconductors 10Y, 10M, 10C, and 10K by the corona electrical charging devices 11Y, 11M, 11C, and 11K, and then performing exposure by the exposure units 12Y, 12M, 12C, and 12K on the basis of input image signals, electrostatic latent images are formed on the electrically-charged photoconductors 10Y, 10M, 10C, and 10K.

The developing devices 30Y, 30M, 30C, and 30K are generally provided with developing rollers 20Y, 20M, 20C, and 20K, developer containers (reservoirs) 31Y, 31M, 31C, and 31K which store liquid developers of the respective colors such as yellow (Y), magenta (M), cyan (C), and black (K), anilox rollers 32Y, 32M, 32C, and 32K which are coating rollers that coat the liquid developers of the respective colors from the developer containers 31Y, 31M, 31C, and 31K on the developing rollers 20Y, 20M, 20C, and 20K, and so on, so that they develop the electrostatic latent images formed on the photoconductors 10Y, 10M, 10C, and 10K by the liquid developers of the respective colors.

The transfer bet 40 is an endless belt, is mounted in a tensioned state on a driving roller 41 and tension rollers 42, 52, and 53, and rotationally driven by the driving roller 41 while coming into contact with the photoconductors 10Y, 10M, 10C, and 10K at primary transfer sections 50Y, 50M, 50C, and 50K. In the primary transfer sections 50Y, 50M, 50C, and 50K, primary transfer rollers 51Y, 51M, 51C, and 51K are disposed to face the photoconductors 10Y, 10M, 10C, and 10K with the transfer belt 40 interposed therebetween, and with the contact positions of the primary transfer rollers with the photoconductors 10Y, 10M, 10C, and 10K as transfer positions, the developed toner images of the respective colors on the photoconductors 10Y, 10M, 10C, and 10K are transferred in sequence with layers to the transfer belt 40, so that a full-color toner image is formed.

In the secondary transfer unit 60, a secondary transfer rollers 61 is disposed to face the belt driving roller 41 with the transfer belt 40 interposed therebetween, and further, a cleaning device which is constituted by a secondary transfer roller cleaning blade 62 is disposed. Then, at a transfer position where the secondary transfer rollers 61 is disposed, a monochromatic toner image or a full-color toner image formed on the transfer belt 40 is transferred to a transfer material such as paper, film, or cloth, which is transported along a transfer material transporting path L.

Further, on the downstream side of the transfer material transporting path L, the first suction device 210, the transfer material transporting device 230, and the second suction device 270 are arranged in sequence, so that the transfer material is transported to the fixing unit 90. At the fixing unit 90, the monochromatic toner image or the full-color toner image transferred to the transfer material such as a paper is fixed to the transfer material such as a paper by fusion and bonding.

The tension roller 42 supports in a tensioned state the transfer belt 40 along with the belt driving roller 41 and so on, and at the place where the transfer belt 40 is supported by the tension roller 42, a cleaning device which is constituted by a transfer belt cleaning blade 49 is disposed in contact with the transfer belt so as to clean residual toner and carrier on the transfer belt 40. Incidentally, a configuration may also be made such that driving force for driving the transfer belt 40 is provided to the tension roller 42 and the belt driving roller 41 is merely used as a belt mounting roller.

The supply of the transfer material to the image forming apparatus is performed by a paper feeding device (not shown). The transfer materials set in the paper feeding device are sent one by one to the transfer material transporting path L at a given timing. In the transfer material transporting path L, the transfer material is transported to a secondary transfer position by gate rollers 101 and 101' and a transfer material guide 102, so that the developed monochromatic toner images or the developed full-color toner image formed on the transfer belt 40 is transferred to the transfer material. The transfer material subjected to secondary transfer is further transported to the fixing unit 90 by a transfer material transport section including the transfer material transporting device 230 at its center, as described above. The fixing unit 90 is constituted by a heating roller 91 and a pressurizing roller 92 biased to the heating roller 91 side at given pressure, and the transfer material passes through a nip of the rollers, so that the monochromatic toner image or the full-color toner image transferred to the transfer material is fixed to the transfer material such as a paper by fusion and bonding.

Here, in explanation of the developing device, since the configurations of the image forming sections and the developing devices for the respective colors are the same, hereinafter, the explanation is made based of the image forming section and the developing device for yellow (Y).

In the image forming section, along the rotation direction of the outer circumference of the photoconductor 10Y, a photoconductor cleaning roller 16Y, a photoconductor cleaning blade 18Y, the corona electrical charging device 11Y, the exposure unit 12Y, the developing roller 20Y of the developing device 30Y, a first photoconductor squeeze roller 13Y, and a second photoconductor squeeze roller 13Y' are disposed.

The photoconductor cleaning roller 16Y rotates in the counter-clockwise direction while coming into contact with the photoconductor 10Y, thereby cleaning a liquid developer remaining after transfer or a un-transferred liquid developer on the photoconductor 10Y. To the photoconductor cleaning roller 16Y, such bias voltage as to attract toner particles in the liquid developer is applied, and a material recovered by the photoconductor cleaning roller 16Y is a solid-rich liquid developer in which toner particles are highly contained.

On the downstream side of the photoconductor cleaning roller 16Y, the photoconductor cleaning blade 18Y which comes into contact with the photoconductor 10Y cleans a carrier component rich liquid developer on the photoconductor 10Y.

On the periphery of the developing roller 20Y of the developing device 30Y, a cleaning blade 21Y, the anilox roller 32Y, and a compaction corona generator 22Y are disposed. A regulating blade 33Y which adjusts the amount of a liquid developer that is supplied to the developing roller 20Y comes into contact with the anilox roller 32Y. In the liquid developer container 31Y, an auger 34Y is accommodated. In addition, at a position facing the photoconductor 10Y, the primary transfer roller 51Y of the first transfer section is disposed with the transfer belt 40 interposed therebetween.

The photoconductor 10Y is a photo-conductor drum which is constituted of a cylindrical member formed on its outer circumferential surface with a photosensitive layer such as an amorphous silicon photo-conductor, and rotates in the clockwise direction.

The corona electrical charging device 11Y is disposed on the upstream side of the rotation direction of the photoconductor 10Y further than a nip portion of the developing roller 20Y and the photoconductor 10Y and applied with voltage from an electric source device (not shown), so that the photoconductor 10Y is subjected to corona electrical charging. The exposure unit 12Y irradiates light to the photoconductor 10Y electrically charged by the corona electrical charging device 11Y, on the downstream side of the rotation direction of the photoconductor 10Y further than the corona electrical charging device 11Y, thereby forming a latent image on the photoconductor 10Y. Incidentally, configurations of the roller and so on which are disposed at a prior stage at a process from the beginning to the end of an image forming process is defined as being on the upstream side further than configurations of the roller and so on which are disposed at a posterior stage.

The developing device 30Y has the compaction corona generator 22Y which applies compaction action, and the developer container 31Y which stores a liquid developer of a state in which toner is dispersed in a carrier at a ratio by weight of about 20%.

Further, the developing device 30Y has the developing roller 20Y which supports the liquid developer, the anilox roller 32Y which is a coating roller for coating the liquid developer on the developing roller 20Y, the regulating blade 33Y which regulates the amount of a liquid developer that is coated on the developing roller 20Y, the auger 34Y which agitates and transports the liquid developer, thereby supplying the liquid developer to the anilox roller 32Y, the compaction corona generator 22Y which makes the liquid developer supported on the developing roller 20Y to be in a compaction state, and the developing roller cleaning blade 21Y which performs the cleaning of the developing roller 20Y.

The liquid developer contained in the developer container 31Y is not a volatile liquid developer of low concentration (about 1 to 3 wt %) and low viscosity, which has volatility at normal temperature and uses, as a carrier, Isopar (trademark: produced by Exxon Corp.) that has been commonly used in the past, but a nonvolatile liquid developer of high concentration and high viscosity, which has non-volatility at normal temperature. That is, the liquid developer in the invention is a liquid developer of high viscosity (when shear velocity at 25° C. is 1000 (1/s), viscoelasticity is about 30 to 300 mPas by using HAAKE RheoStress RS600), in which a solid material of 1 μm average grain diameter having a coloring agent such as pigment dispersed in thermoplastic resin is added along with a dispersant to liquid solvent such as organic solvent, silicon oil, mineral oil, or edible oil, so that the toner solid content concentration is about 15% to 25%.

The anilox roller 32Y is to function as a coating roller which supplies and coats the liquid developer on the developing roller 20Y. The anilox roller 32Y is a roller which is a cylindrical member and in which a concave-convex surface is formed by grooves helically engraved finely and uniformly in the surface so as to easily support the liquid developer on the surface. By the anilox roller 32Y, the liquid developer is supplied from the developer container 31Y to the developing roller 20Y. In the operation of the device, as shown in FIG. 1, the auger 34Y rotates in the counter-clockwise direction, thereby supplying the liquid developer to the anilox roller 32Y, and the anilox roller 32Y rotates in the counter-clockwise direction, thereby coating the liquid developer on the developing roller 20Y.

The regulating blade 33Y is an elastic blade constituted by covering an elastic body on its surface and is constituted by a rubber portion made of urethane rubber or the like and coming into contact with the surface of the anilox roller 32Y, and so on. Then, the regulating blade regulates and adjusts the film thickness and the amount of the liquid developer which is supported and transported by the anilox roller 32Y, thereby adjusting the amount of the liquid developer which is supplied to the developing roller 20Y.

The developing roller cleaning blade 21Y is constituted of rubber which comes into contact with the surface of the developing roller 20Y, and so on, and is disposed on the downstream side of the rotation direction of the developing roller 20Y further than a developing nip portion where the developing roller 20Y comes into contact with the photoconductor 10Y, thereby scraping off and removing the liquid developer remaining on the developing roller 20Y.

The compaction corona generator 22Y is an electric field applying section which increases the electrifying bias of the surface of the developing roller 20Y, and by the compaction corona generator 22Y, at a compaction portion, an electric field is applied from the compaction corona generator 22Y side toward the developing roller 20Y. Incidentally, the electric field applying section for the compaction, a compaction roller or the like may also be used in place of the corona discharge of a corona discharger shown in FIG. 1.

The compacted developer supported on the developing roller 20Y is developed corresponding to the latent image of the photoconductor 10Y by the application of a given electric field at the developing nip portion where the developing roller 20Y comes into contact with the photoconductor 10Y.

The developer remaining after the development is scraped off and removed by the developing roller cleaning blade 21Y, drops into a recovery portion in the developer container 31Y, and then reused. Incidentally, the carrier and the toner which are reused in this way are not in a color mixture state.

A photoconductor squeeze device which is disposed on the upstream side of the primary transfer position is disposed to face the photoconductor 10Y on the downstream side of the developing roller 20Y, thereby recovering the surplus carrier of the developed toner image to the photoconductor 10Y. The photoconductor squeeze device is constituted by the first photoconductor squeeze roller 13Y and the second photoconductor squeeze roller 13Y', which are each constituted of an elastic roller member that rotates in sliding-contact with the photoconductor 10Y, and has the function of recovering a surplus carrier and essentially unnecessary fogging toner from the developed toner image on the photoconductor 10Y, thereby increasing a toner particle proportion in a developed image (toner image). Further, a given bias voltage is applied to the photoconductor squeeze rollers 13Y and 13Y'.

The surface of the photoconductor 10Y passed through the squeeze device which is constituted by the first photoconductor squeeze roller 13Y and the second photoconductor squeeze roller 13Y' enters into the primary transfer section 50Y. In the primary transfer section 50Y, the developer image developed on the photoconductor 10Y is transferred to the transfer belt 40 by the primary transfer roller 51Y. In the primary transfer section 50Y, by the action of a transfer bias which is applied to a primary transfer backup roller 51, the toner image on the photoconductor 10Y is transferred to the transfer belt 40 side. Here, the photoconductor 10Y and the transfer belt 40 are constituted so as to move at a constant speed, so that the driving load of rotation and movement is reduced, and also, the disturbance action of the photoconductor 10Y on the developed toner image is suppressed.

By the same process as the development process of the developing device 30Y, also in the developing device 30M, 30C, and 30K, toner images of magenta (M), cyan (C), and black (K) are respectively formed on the photoconductors 10M, 10C, and 10K. Then, the transfer belt 40 passes through the nips of the primary transfer sections 50 of the respective colors, yellow (Y), magenta (M), cyan (C), and black (K), so that the developers (developed images) on the photoconductors of the respective colors are transferred to the transfer belt, whereby the colors are superimposed, and then, the transfer belt having the superimposed colors enters into a nip portion of the secondary transfer unit 60.

The transfer belt 40 passed through the secondary transfer unit 60 is circulated in order to again receive transfer images at the primary transfer sections 50. However, on the upstream side before the execution of the primary transfer sections 50, the transfer belt 40 is cleaned by the transfer belt cleaning blade 49, etc.

The transfer belt 40 has a three-layer structure in which an intermediate elastic layer made of polyurethane is provided on a polyimide base layer and a PFA surface layer is provided on the intermediate layer. Such a transfer belt 40 is used disposed such that the polyimide base layer side is mounted to be wound around the belt driving roller 41 and the tension rollers 42, 52, and 53 and the toner image is transferred to the PFA surface layer. Since the transfer belt 40 constituted in this way and having elasticity has excellent adaptation properties and response properties to the surface of the transfer material, the belt is effective in sending and transferring, in particular, toner particles having a small grain diameter to concave portions of the transfer material at the time of the secondary transfer.

Figure 2:
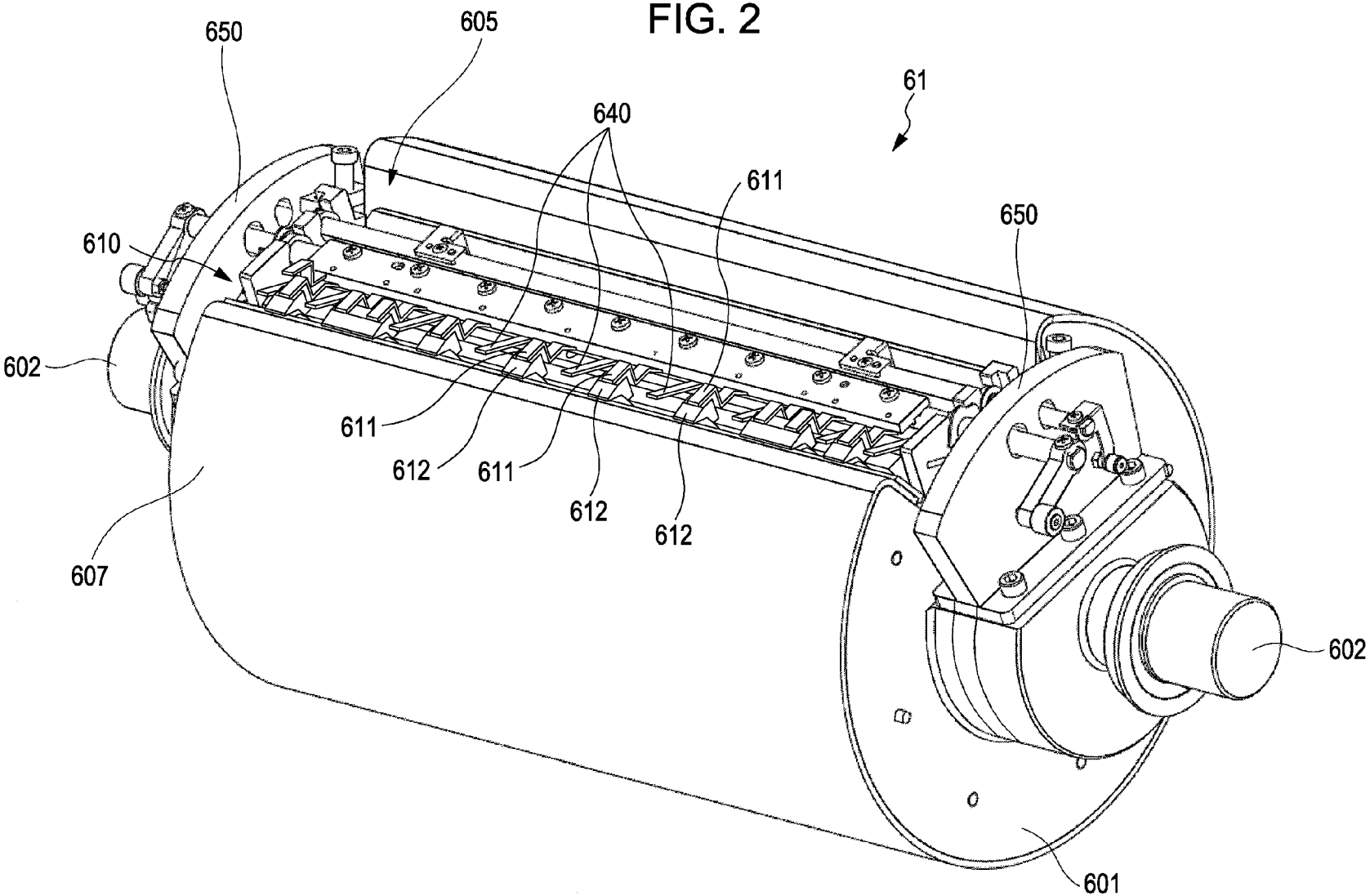
FIG. 2 is a perspective view of a secondary transfer roller which is used in the image forming apparatus concerning the embodiment of the invention.

Next, the secondary transfer roller 61 which is used in the image forming apparatus concerning this embodiment will be explained in more detail. FIG. 2 is a perspective view of the secondary transfer roller which is used in the image forming apparatus concerning the embodiment of the invention.

In FIG. 2, reference numeral 601 denotes a roller body portion; 602, roller shaft portion; 605, a concave groove; 607, an elastic member; 610, a transfer material gripping mechanism; 611, a transfer material gripping portion; 612, a transfer material gripping portion bearing portion; 640, a transfer material separating member; and 650, a contact member. The roller body portion 602 is constituted by an elastic member supporting member having conductive properties, which supports the elastic member 607 that supports the transfer material S, and a separating member supporting member which supports the transfer material separating member 640.

At both end portions of the roller body portion 601 of the secondary transfer roller 61, the roller shaft portions 602 are provided, and the roller body portion is mounted on an apparatus main body to be rotatable about the roller shaft portions 602. Further, the concave groove 605 extending in an axial direction is provided in the roller body portion 601, the transfer material gripping mechanism 610 is provided in the concave groove 605, and the elastic member 607 is provided on the roller body portion 601 other than the concave groove 605. The transfer material gripping mechanism 610 is a mechanism for gripping or releasing the transfer material. Further, the elastic member 607 is constituted of a semi-conductive elastic rubber layer having an electric resistance component, and when the transfer material passes through the secondary transfer nip of the secondary transfer unit in a state where the transfer material is wound on the elastic member 607, the transfer of the toner image from the transfer belt 40 to the transfer material is performed.

The transfer material gripping mechanism 610 is generally constituted by a plurality of pairs of transfer material gripping portions 611 and transfer material gripping portion bearing portions 612, which are discretely provided over the axial direction of the roller, and a plurality of transfer material separating members 640 which are appropriately disposed between the pairs over the axial direction of the roller. All transfer material gripping portions 611 are constituted to be movable and to grip the transfer material by operating to pinch the transfer material between them and the transfer material gripping portion bearing portions 612, or release the transfer material by operating to leave a space between them and the transfer material gripping portion bearing portions 612. Further, all transfer material separating members 640 operate to push out the transfer material gripped by the transfer material gripping portions 611 and the transfer material gripping portion bearing portions 612 in a direction receding from the secondary transfer roller 61 side.

At both ends of the roller shaft portion 602 of the secondary transfer roller 61, two contact members 650 are provided. The contact member 650 is of a structure having a contact surface, etc. at a region corresponding to a region of the concave groove 605 provided in the secondary transfer roller 61 when viewed in the axial direction of the roller, and the contact surface comes into contact with a contacted member which will be described later, so that, a relative position of the secondary transfer roller 61 and the belt driving roller 41 is regulated.

Figure 3:
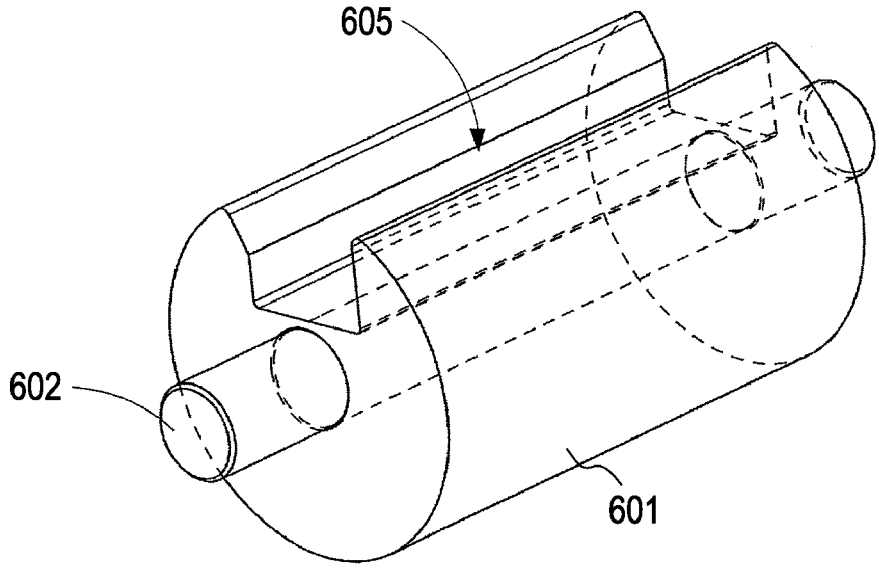
FIG. 3 is a view showing a body portion of the secondary transfer roller.

The secondary transfer roller 61 shown in FIG. 3 has the cylindrical body portion 601 which is formed of an electrically-conductive base material. The shaft portion 602 which is formed of electrically-conductive metal is disposed to penetrate the body portion 601. In the body portion 601, the concave groove 605 extending the axial direction is formed.

Figure 4:
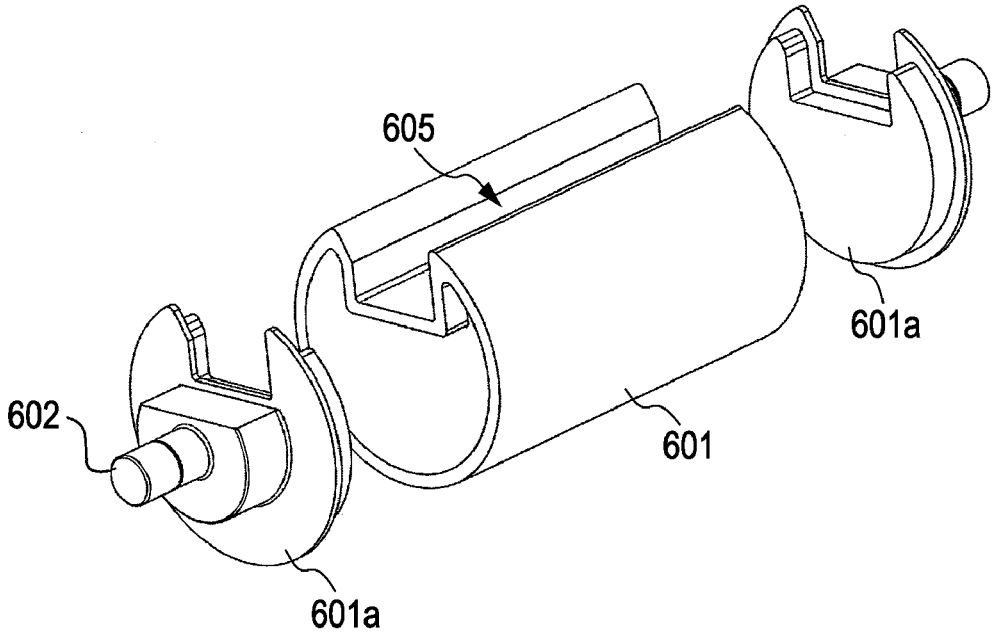
FIG. 4 is a view showing the body portion of the secondary transfer roller.

The secondary transfer roller 61 shown in FIG. 4 has the cylindrical body portion 601 which is formed of an electrically-conductive base material. The concave groove 605 extending the axial direction is formed in the cylindrical body portion 601. A flange 601*a* formed of electrically-conductive metal is disposed at least one end of the cylindrical body portion 601. The shaft portion 602 is integrally formed at the flange 601*a*. Since the wall thickness of the cylindrical body portion 601 can be thinned, stability of the rotation of the roller can be realized by reduction in weight, and also, the roller can be worked at a reduced cost.

Figure 5:
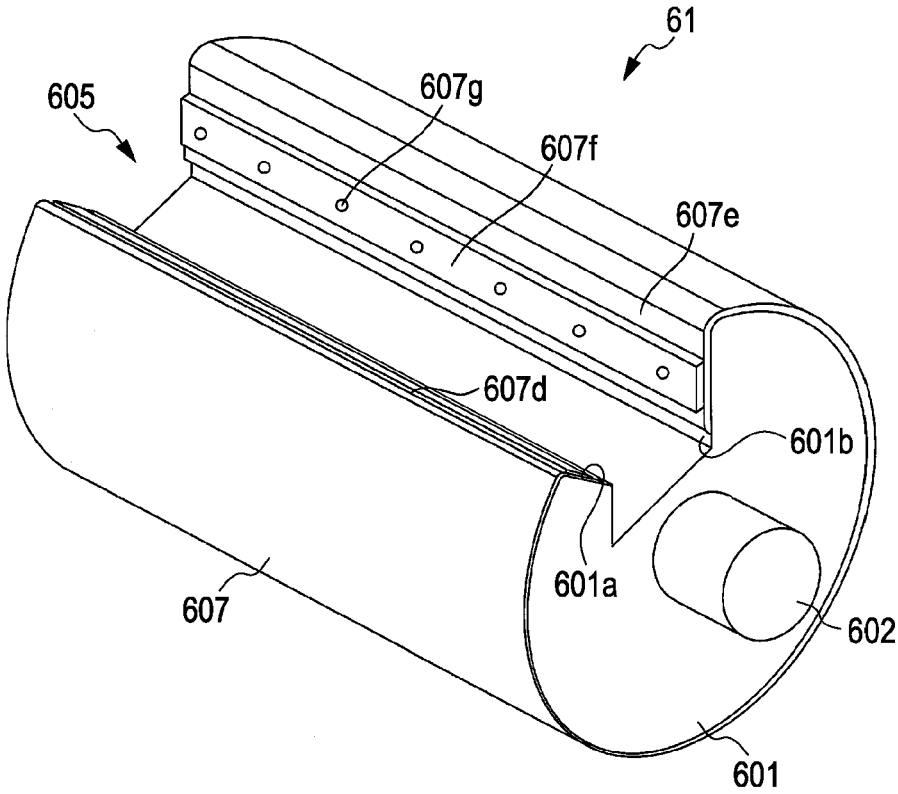
FIG. 5 is a perspective view showing the secondary transfer roller.
Figure 6:
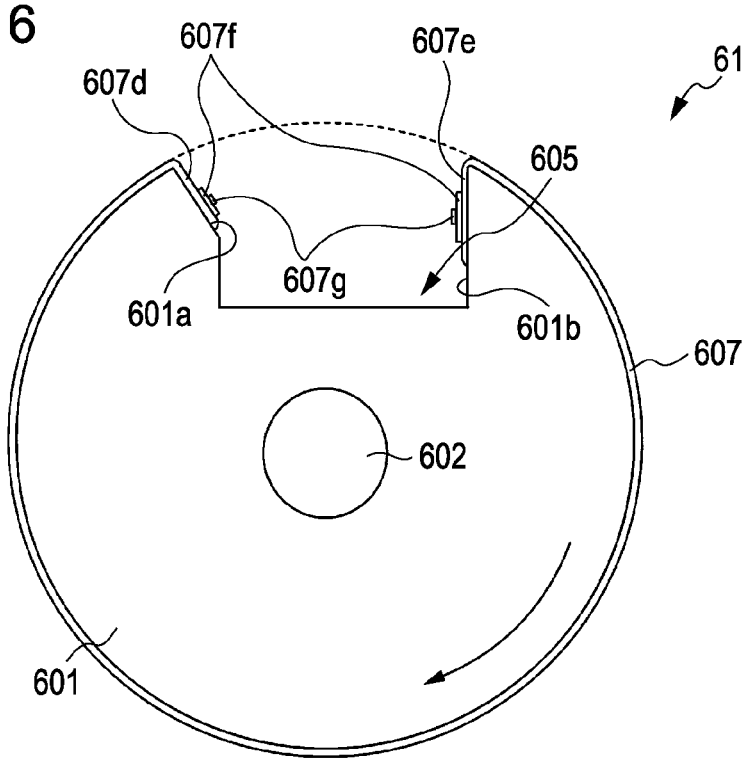
FIG. 6 is a cross-sectional view showing the secondary transfer roller.

As shown in FIGS. 5 and 6, the elastic member 607 is disposed to wrap the circumference of the cylindrical body portion 601, which is formed of an electrically-conductive base material, of the secondary transfer roller 61.

The electrically-conductive body portion 601 of the secondary transfer roller 61 has the concave groove 605. The concave groove 605 extends in the direction of the shaft portion 602 of the body portion 601. Also, the secondary transfer roller 61 has the elastic member 607 adhered to the outer circumferential surface of a circular arc portion of the electrically-conductive body portion 601. By the elastic member 607, a resistive layer is formed on the outer circumferential surface of the circular arc portion of the secondary transfer roller 61. Both end portions 607*d* and 607*e* of the elastic member are adhered to wall surfaces 601*a* and 601*b* in the concave groove 605 formed in the body portion 601, and the other portion of the elastic member merely wraps the body portion 601 and is not bonded or fixed to the body portion 601. For example, it is preferable that plates 607*f* extend on both end portions 607*d* and 607*e* of the elastic member 607 in the direction of the shaft portion 602 and fastened to the body portion 601 by screws 607*g* or the like. In addition, the bonding of both end portions 607*d* and 607*e* of the elastic member 607 to the concave groove 605 is not limited to this, but other methods may also be used.

Figure 7:
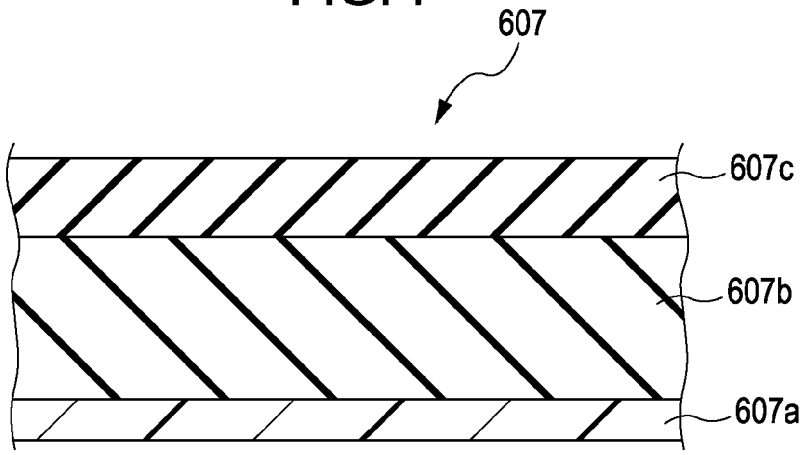
FIG. 7 is a cross-sectional view showing an elastic member.

As shown in FIG. 7, the elastic member 607 has a 3-layer structure including a base material layer 607*a*, an elastic layer 607*b*, and a surface layer 607*c*.

Next, the elastic member 607 wrapped around the secondary transfer roller 61 will be explained using examples.

Here, volume resistivity representing configurations of the examples was measured using a resistance measurement instrument "Hiresta UR probe" manufactured by Mitsubishi Chemical Corporation. A film cut into a length of 400 mm was taken as a sample, and with respect to 3 places at a constant pitch in the widthwise direction of the sample and 4 places in the lengthwise (circumferential) direction, 12 places in total, volume resistivity was measured with the applied voltage of 100 V and after 10 seconds and expressed by an average value.

The elastic member 607 of Example 1 has the following configuration.

Configuration: single layer
Volume resistivity: $1\times10^{10}$ (Ω·cm)
Material: urethane rubber
Film thickness: 0.5 mm
Electrical conducting material: ion conductive material
Sheet material surface hardness: JISA90°

In addition, the intermediate transfer belt 40 of Example 1 has the following configuration.

Configuration: single layer belt
Material: polyimide resin
Film thickness: 100 μm
Electrical conducting material: electron conductive material (carbon)

When the elastic member 607 and the intermediate transfer belt 40 were used in the image forming apparatus of the first embodiment of a single nip configuration, it was possible to increase a secondary transfer properties to a coated paper.

Next, Example 2 will be explained.

The elastic member 607 of Example 2 is of a 2-layer structure and has the following configuration.

Configuration: 2 layers (Young's modulus: 2 GPa)
Volume resistivity: $1\times10^{7}$ (Ω·cm)
Base Material Layer
Material: polyimide
Film thickness: 90 μm
Electrical conducting material: electron conductive material (carbon)
Elastic Layer
Material: urethane rubber
Film thickness: 3.0 mm
Electrical conducting material: electron conductive material (carbon)
Sheet material surface hardness: JISA35°

In addition, it is preferable that the Young's modulus of the elastic member 607 be 2 to 5 GPa. Also, the electrical conducting material of the elastic member 607 may also be an ion conductive material, or a hybrid conductive material including an electron conductive material (carbon) and an ion conductive material. Also, rubber hardness may also be 30° to 70°.

In addition, the intermediate transfer belt 40 of Example 2 has the following configuration.

Configuration: 3-layer belt
Base Material Layer
Material: polyimide resin
Film thickness: 100 μm
Electrical conducting material: electron conductive material (carbon)
Elastic Layer
Material: urethane rubber
Film thickness: 250 μm
Electrical conducting material: electron conductive material (carbon)
Surface Layer
Material: fluorine-containing rubber with fluorine resin added
Film thickness: 25 μm Configuration: 3-layer belt
Base Material Layer
Material: polyimide resin
Film thickness: 90 μm
Electrical conducting material: electron conductive material (carbon)
Elastic Layer
Material: urethane rubber
Film thickness: 150 μm
Electrical conducting material: electron conductive material (carbon)
Surface Layer
Material: fluorine-containing rubber with fluorine resin added
Film thickness: 5 μm In addition, in Examples 3 to 6, the elastic member 607 and the intermediate transfer belt 40 were used in the image forming apparatus of the first embodiment of a single nip configuration, and in Example 7, the elastic member 607 and the intermediate transfer belt 40 were used in the image forming apparatus of the second embodiment of a wound nip configuration.

The elastic members 607 of Examples 3 to 7 are explained. Table 1 shows the configurations of the elastic members 607 of Examples 3 to 7.

TABLE 1

| Example | Base layer: polyimide | Elastic layer: urethane rubber | Surface layer: fluorine-containing rubber with fluorine resin | Physical properties of elastic member Volume resistivity Surface hardness |
|---|---|---|---|---|
| 3 | Electrical conducting material: no Film thickness: 50 μm | Electrical conducting material: electron conductive material Film thickness: 5.0 mm | Electrical conducting material: no Film thickness: 5 μm | $6 \times 10^{10}$ Ω · cm 40° |
| 4 | Electrical conducting material: electron conductive material + ion conductive material Film thickness: 90 μm | Electrical conducting material: electron conductive material Film thickness: 2.5 mm | Electrical conducting material: electron conductive material + ion conductive material Film thickness: 5 μm | $2 \times 10^{6}$ Ω · cm 40° |
| 5 | Electrical conducting material: electron conductive material Film thickness: 90 μm | Electrical conducting material: electron conductive material Film thickness: 1.5 mm | Electrical conducting material: electron conductive material Film thickness: 25 μm | $8 \times 10^{8}$ Ω · cm 40° |
| 6 | Electrical conducting material: no Film thickness: 50 μm | Electrical conducting material: electron conductive material Film thickness: 0.5 mm | Electrical conducting material: electron conductive material + ion conductive material Film thickness: 25 μm | $5 \times 10^{9}$ Ω · cm 50° |
| 7 | Electrical conducting material: electron conductive material Film thickness: 90 μm | Electrical conducting material: electron conductive material Film thickness: 2.0 mm | Electrical conducting material: no Film thickness: 5 μm | $6 \times 10^{8}$ Ω · cm 65° |

When the elastic member 607 and the intermediate transfer belt 40 were used in the image forming apparatus of the first embodiment of a single nip configuration, it was possible to reduce transfer omissions to a J-paper manufactured by Fuji Xerox Co., Ltd., thereby increasing transfer properties.

Next, Examples 3 to 7 will be explained. FIG. 7 is a view showing the 3-layer elastic member 607 as the elastic member of the secondary transfer roller. As shown in FIG. 7, the elastic member 607 which is wrapped around the circumference of the secondary transfer roller 61 of Examples 3 to 7 has a 3-layer structure including the base material layer 607*a* as a first layer, the elastic layer 607*b* as a second layer, and the surface layer 607*c* as a third layer.

In addition, the intermediate transfer belts 40 of Examples 3 to 7 have the following configurations.

As shown in Table 1, the elastic member 607 of Example 3 can reduce a coefficient of friction of the intermediate transfer belt 40 and the secondary transfer roller 61 by forming the surface layer 607*c*, so that it is possible to reduce distortion of the elastic layers of both members.

By the configuration as shown in Table 1, in the elastic member 607 of Example 4, it is possible to secure secondary transfer efficiency of 90% or more.

As shown in Table 1, in the elastic member 607 of Example 5, it is possible to reduce environmental changes in volume resistivity to one digit in environmental temperatures of a range of 10° C. to 35° C. by using the electron conductive materials as all electrical conducting materials, and also, it is possible to reduce micro-distortions due to the addition of the electron conductive materials.

As shown in Table 1, in the elastic member 607 of Example 6, it is possible to improve release properties of a paper by lowering a resistance value of the surface layer.

The elastic member 607 of Example 7 uses a winding method as a transfer configuration. Also, by setting rubber hardness of the elastic member 607 to be 65°, adaptation properties of a printing paper to concave and convex portions can be improved, so that it is possible to further improve transfer omission. Further, by adopting a winding nip as a nip configuration, it is possible to improve secondary transfer efficiency, thereby reducing waste toner.

In addition, in a case where resistance of the elastic member 607 wrapped around the secondary transfer roller 61 is high, a trouble does not occur that distortion of the elastic member 607 is accumulated, thereby causing a transfer defect. However, the resistance is too high, so that a necessary electric field cannot be applied to toner particles, whereby transfer properties needed in the secondary transfer by a bias cannot be secured.

Further, in a case where resistance of the elastic member 607 wrapped around the secondary transfer roller 61 is low, a resistance value of the secondary transfer roller 61 is lowered compared to a resistance value of the transfer material S, so that at a portion where the transfer material S does not exist, electric current flows away, whereas at a portion where the transfer material S exists, a sufficient electric field cannot be applied to toner particles, so that transfer properties needed in the secondary transfer cannot be secured. Further, a trouble also occurs that electric charges are injected to toner, so that toner electrification is disturbed.

Therefore, it is preferable to set the volume resistivity of the elastic member 607 of this embodiment to be $1\times10^{6}$ (Ω·cm) to $1\times10^{11}$ (Ω·cm).

Also, as a material of the base material layer 607*a*, polyimide or polyamide-imide can be given as an example. Also, in a case where an electrical conducting material such as carbon is included in the base material layer 607*a*, it is preferable that the used amount thereof usually be about 5 to 25% by weight with respect to the base material layer 607*a*.

Also, as a material of the elastic layer 607*b*, urethane rubber, silicone rubber, fluorine-containing rubber, butyl rubber, or acrylic rubber can be given as an example. Also, in a case where an electrical conducting material such as carbon is included in the elastic layer 607*b*, it is preferable that the used amount thereof usually be about 5 to 30% by weight with respect to the elastic layer 607*b*.

Also, as a material of the surface layer 607*c*, fluorine-containing rubber, or fluorine resin can be given as an example. Also, in a case where an electrical conducting material such as carbon is included in the surface layer 607*c*, it is preferable that the used amount thereof usually be about 5 to 25% by weight with respect to the surface layer 607*c*.

FIGS. 8 to 12 are views showing embodiments in which a secondary transfer bias is applied to the electrically-conductive body portion 601 of the secondary transfer roller 61. The electrically-conductive body portion 601 of the secondary transfer roller 61 is applied with a secondary transfer bias by a secondary transfer bias applying section. In this embodiment, the secondary transfer bias is subjected to constant current control, so that, for example, the electric current at the time of the secondary transfer is set to be 200 μA.

Figure 8:
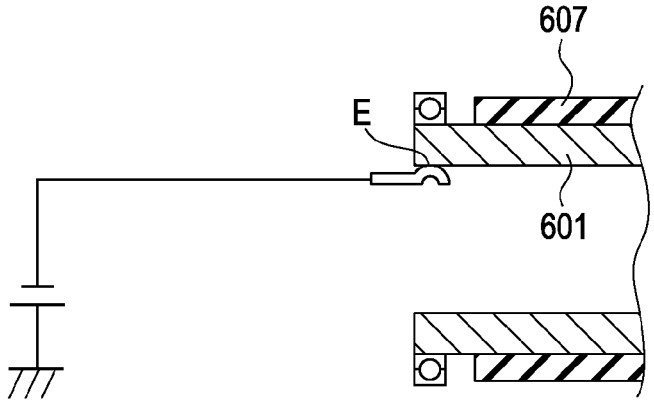
FIG. 8 is a view showing the structure of applying a bias to the secondary transfer roller.

The secondary transfer bias application shown in FIG. 8 is configured such that a contact E of the secondary transfer bias applying section comes into direct contact with the electrically-conductive body portion 601.

Figure 9:
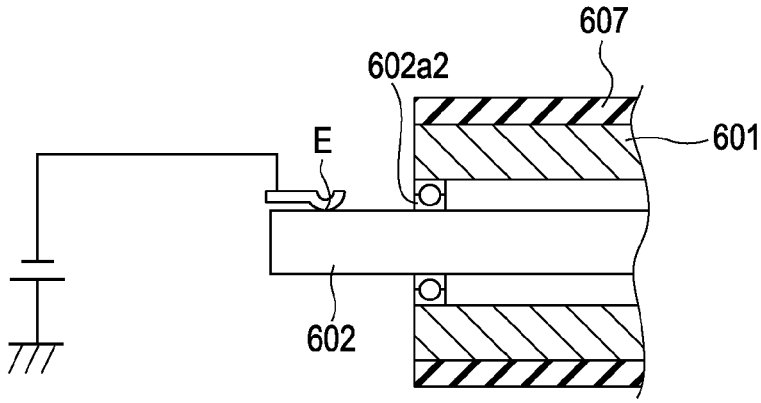
FIG. 9 is a view showing the structure of applying a bias to the secondary transfer roller.

FIG. 9 shows the secondary transfer bias application in a case where the electrically-conductive body portion 601 is formed to be hollow and the shaft 602 penetrates and is disposed in the hollow body portion 601 via an electrically-conductive bearing member 602*a*2. As the electrically-conductive bearing member 602*a*2, there is, for example, an electrically-conductive, oil-containing bearing, a bearing, or the like. Since the body portion 601 is guided by the penetrating shaft 602, deviation can be suppressed.

Figure 10:
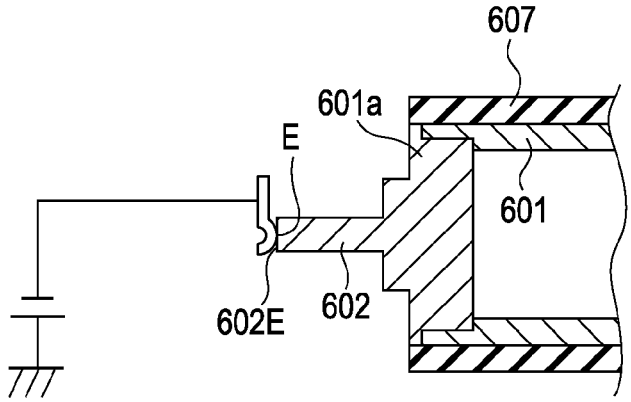
FIG. 10 is a view showing the structure of applying a bias to the secondary transfer roller.

The secondary transfer bias application shown in FIG. 10 is applied to the secondary transfer roller 61 in which the flange 601*a* with the shaft portion 602 integrally formed is disposed at least one end portion of both end portions of the electrically-conductive body portion 601 shown in FIG. 4. The contact E of the secondary transfer bias applying section is constituted to come into contact with an end portion 602E of the shaft portion 602 of the flange 601*a*.

Figure 11:
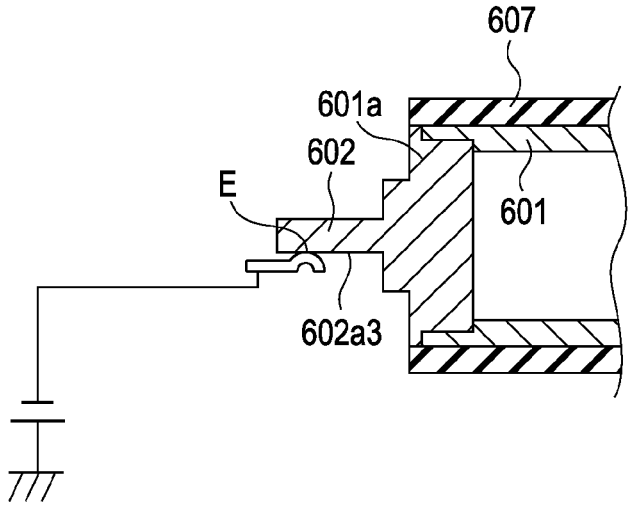
FIG. 11 is a view showing the structure of applying a bias to the secondary transfer roller.

The bias application shown in FIG. 11 is applied to the secondary transfer roller 61 in which the flange 601*a* with the shaft portion 602 integrally formed is disposed at the electrically-conductive body portion 601 shown in FIG. 4. The contact E of the secondary transfer bias applying section is constituted to come into contact with a circumferential portion 602*a*3 of the shaft portion 602 of the flange 601*a*.

Figure 12:
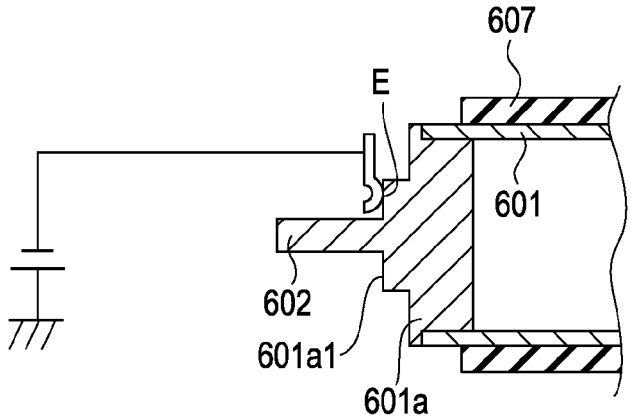
FIG. 12 is a view showing the structure of applying a bias to the secondary transfer roller.

The secondary transfer bias application shown in FIG. 12 is applied to the secondary transfer roller 61 in which the flanges 601*a* with the shaft portion 602 integrally formed are disposed at both end portions of the electrically-conductive body portion 601 shown in FIG. 4. The contact E of the secondary transfer bias applying section is constituted to come into contact with an end portion 601*a*1 of the flange 601*a*.

Figure 13:
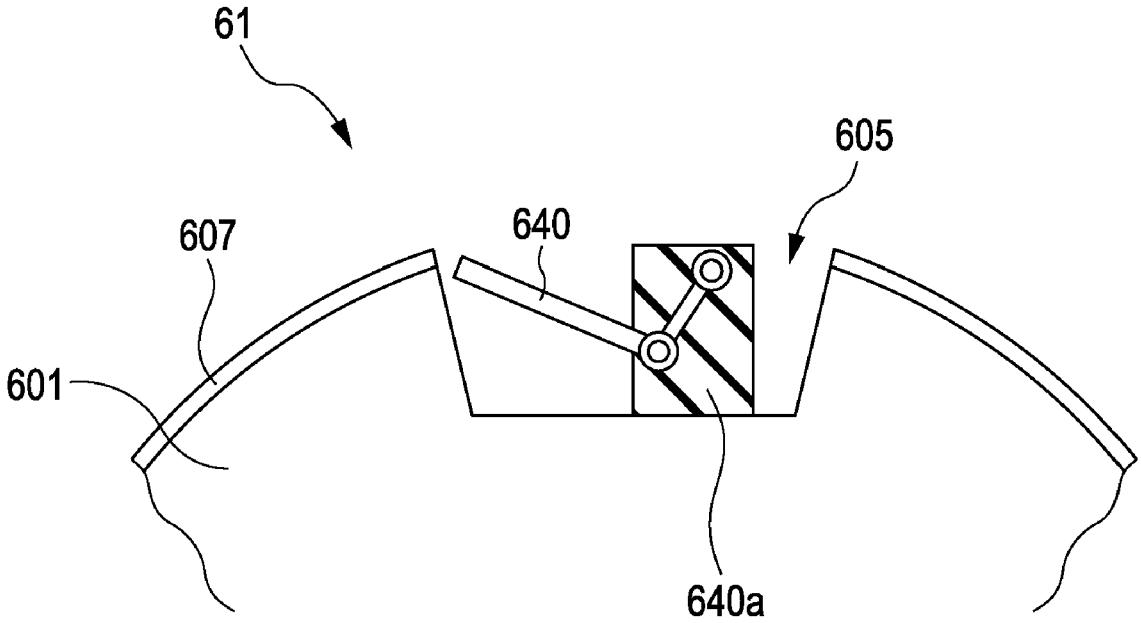
FIG. 13 is a view showing a state where a transfer material separating member is supported in a concave portion through an insulation member.

FIG. 13 is a view showing a state where the transfer material separating member 640 is supported in the concave groove 605 of the secondary transfer roller 61 by an insulation member 640*a*. As an insulation material, a resin material such as POM (polyacetal) or ABS (acrylonitrile butadiene styrene) is suitable. In this secondary transfer roller 61, since the secondary transfer bias is applied to the electrically-conductive body portion 601, by supporting the transfer material separating member 640 by the insulation support member 640*a*, electric discharge from the transfer material separating member 640 is prevented at the time of the separating of the transfer material S.

FIGS. 14A to 14D are diagrams in which each configuration of the transfer material gripping mechanism 610 schematically shown is viewed from the axial direction. Also, the respective states of the transfer material gripping mechanism 610, which are shown in FIGS. 14A to 14D, are to roughly show operation states which are taken by the transfer material gripping mechanism 610 when the transfer material gripping mechanism 610 of the secondary transfer roller 61 has reached the positions marked as I, II, III, and IV in the secondary transfer roller 61 of FIG. 1.

Figure 14A:
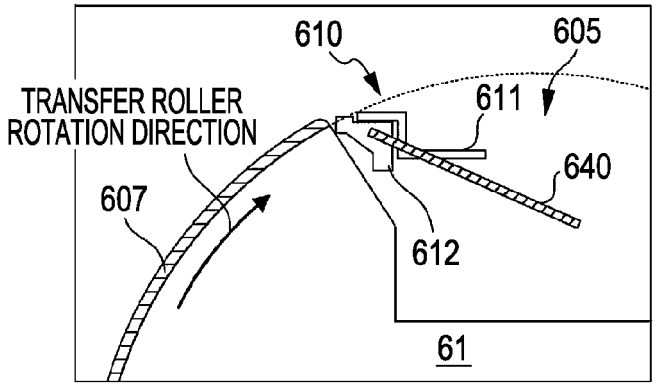
FIGS. 14A to 14D are views showing the operation of a transfer material gripping mechanism of the secondary transfer roller which is used in the image forming apparatus concerning the embodiment of the invention.

FIG. 14A shows a state at the time when the secondary transfer roller 61 rotates without gripping the transfer material by the transfer material gripping mechanism 610. At this time, when the secondary transfer roller 61 is regarded as, for example, a circular cylinder, the transfer material gripping portion 611 and the transfer material separating member 640 are retreated from the outermost circumference of the cylinder. This shows a state at the time when in the rotation process of the secondary transfer roller 61, the transfer material gripping mechanism 610 exists in the range of I in FIG. 1.

Figure 14B:
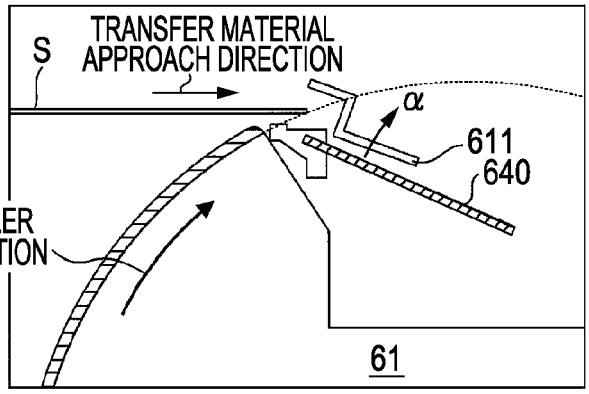

FIG. 14B is a view showing a state where the transfer material gripping portion 611 moves in a α direction, thereby forming a given space between it and the transfer material gripping portion bearing portion 612, and preparation to grip the transfer material S which enters into the space by the transfer material gripping portion 611 and the transfer material gripping portion bearing portion 612 is made. This is to show a state where in the rotation process of the secondary transfer roller 61, the transfer material gripping mechanism 610 reaches the position of II in FIG. 1, thereby making preparation for the gripping of the transfer material that is entered along the transfer material guide 102 with the rotation of the gate rollers 101 and 101'.

Figure 14C:
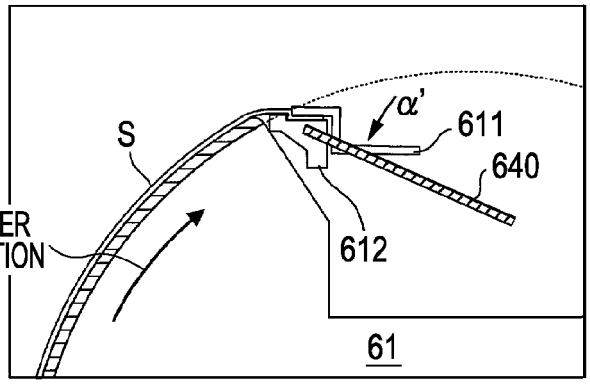

FIG. 14C shows a state where the transfer material gripping portion 611 moves in a α' direction, so that the transfer material S that has entered into the space is gripped between the transfer material gripping portion and the transfer material gripping portion bearing portion 612. At this time, the transfer material S having one end gripped by the transfer material gripping mechanism 610 is in a state where in accordance with the rotation of the secondary transfer roller 61, the transfer material is electrostatic-adsorbed to and wound on the roller body portion 601 applied with a transfer bias of the secondary transfer roller 61. In this manner, since the transfer material S is gripped by the transfer material gripping mechanism 610 at a stage before the transfer material enters into the secondary transfer nip, the positioning of the transfer material S on which a toner image is to be transferred can be exactly performed. In the rotation process of the secondary transfer roller 61, when the transfer material gripping mechanism 610 is located in a range of III in FIG. 1, the state of FIG. 14C is maintained.

Figure 14D:
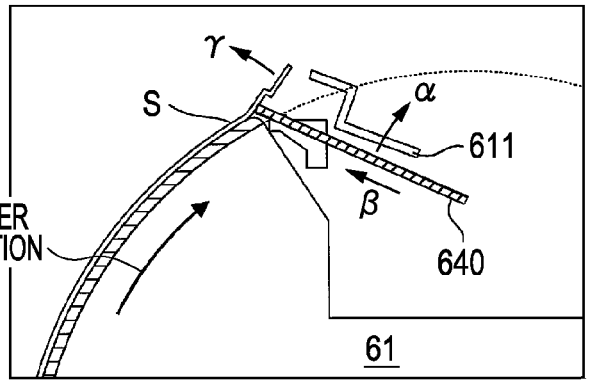

FIG. 14D shows a state where the transfer material gripping portion 611 moves in a α direction, thereby forming a given space between it and the transfer material gripping portion bearing portion 612, so that the transfer material S is released, and also, the transfer material separating member 640 moves in a β direction, thereby pushing the transfer material S in a direction receding from the secondary transfer roller 61. This operation state is a state when in the rotation process of the secondary transfer roller 61, the transfer material gripping mechanism 610 reaches the position of IV in FIG. 1, thereby delivering the transfer material S, to which the toner image is transferred through the secondary transfer nip and which is adhered to the secondary transfer roller 61 by electrostatic adsorption, to the subsequent transfer material transport process.

As described above, the transfer material gripping mechanism 610 grips the transfer material S before the transfer material S passes through the secondary transfer nip of the transfer belt 40 and the secondary transfer roller 61, so that the positioning of the transfer material S, to which the toner image is to be transferred, is exactly performed, and also, the transfer material S in a state of being electrostatic-adsorbed and wound on the secondary transfer roller 61 passes through the secondary transfer nip of the transfer belt 40 and the secondary transfer roller 61. The electrostatic-adsorbed transfer material S passed through the secondary transfer nip is reliably separated from the secondary transfer roller 61 by the operation of the transfer material separating member 640, as shown in FIG. 14D, and at the same time, can be reliably conducted to the subsequent transfer material S transport process. Since the transfer material separating member 640 is supported in the concave groove 605 by the insulation supporting member 640*a*, electric discharge from the transfer material separating member 640 is prevented at the time of the separating of the transfer material S from the secondary transfer roller 61.

Figure 15:
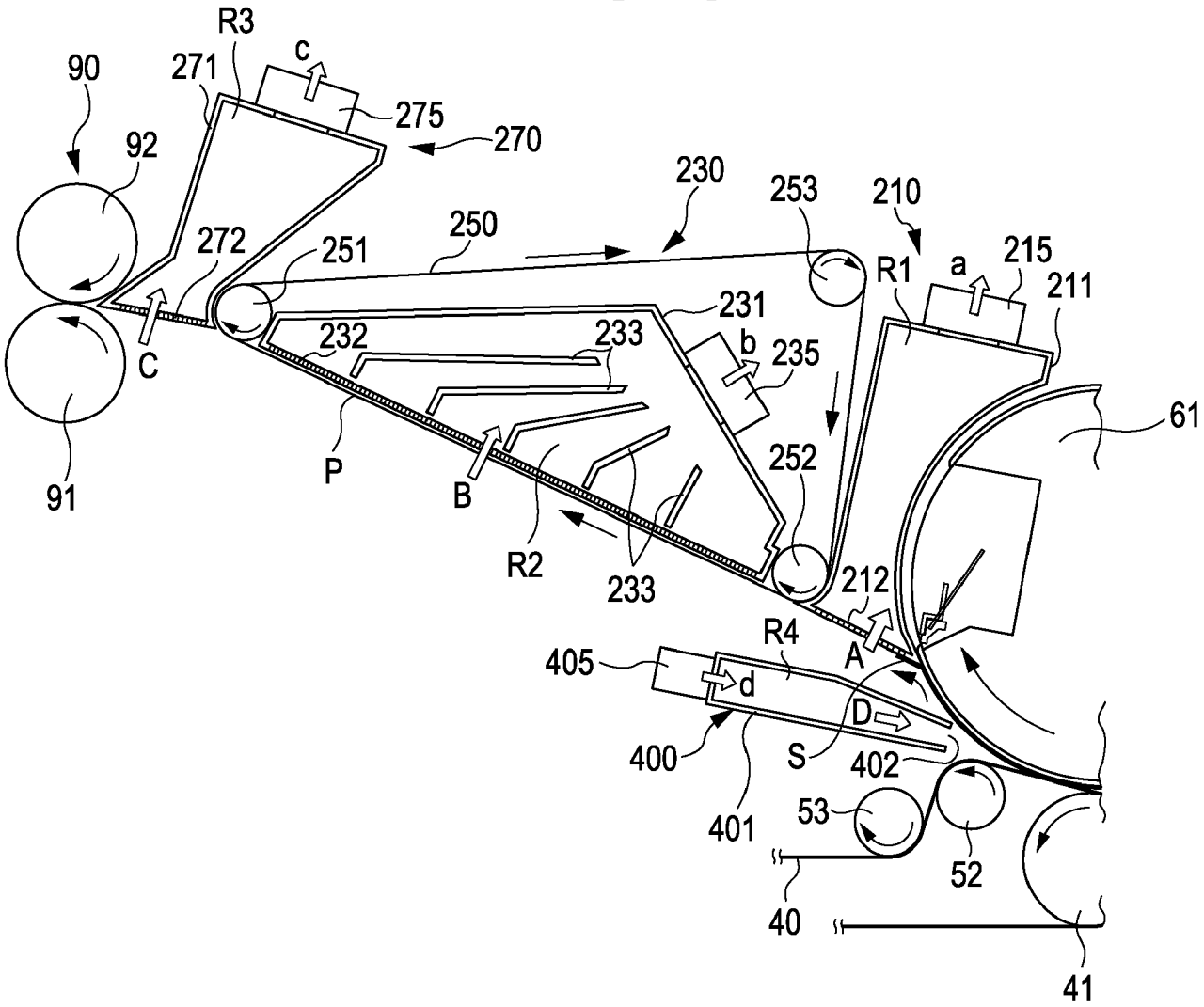
FIG. 15 is a view explaining the operation of a transfer material transport section which is used in the image forming apparatus concerning the embodiment of the invention.
Figure 16:
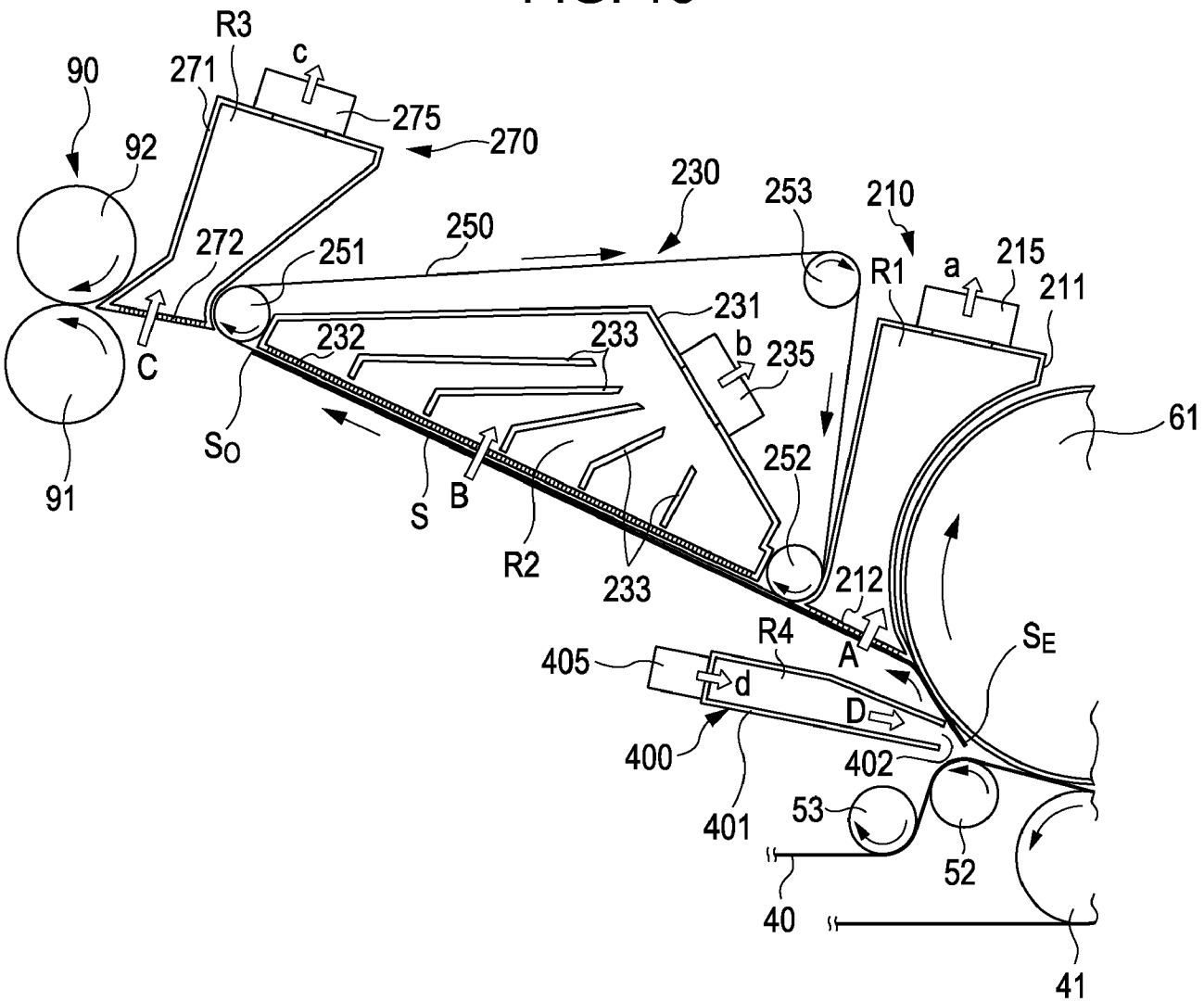
FIG. 16 is a view explaining the operation of the transfer material transport section which is used in the image forming apparatus concerning the embodiment of the invention.

As described above, the transfer material S released from the transfer material gripping mechanism 610 is then transported to the fixing unit 90. Next, a transport section for performing the transportation is explained. FIGS. 15 and 16 are views explaining the operation of the transfer material transport section which is used in the image forming apparatus concerning the embodiment of the invention. In FIGS. 15 and 16, reference numeral 210 denotes the first suction device; 211, an housing portion; 212, a suction face; 215, an air current generation portion; 230, the transfer material transporting device; 231, an housing portion; 232, a suction face; 233, a partition wall member; 235, an air current generation portion; 250, a transfer material transporting member; 251, a transfer material transporting member driving roller; 252 and 253, transfer material transporting member mounting rollers; 270, the second suction device; 271, an housing portion; 272, a suction face; 275, an air current generation portion; 400, a blower; 401, an housing portion; 402, an opening portion; and 405, an air current generation portion.

The first suction device 210 has the housing portion 211 with the air current generation portion 215, such as a sirocco fan, mounted, and is constituted such that exhaust from a space R1 in the housing portion 211 to the exterior of the housing portion 211 can be performed by the air current generation portion 215. The lower face side of the housing portion 211 constitutes the suction face 212 provided in its one surface with a plurality of venting holes. The first suction device 210 performs the exhaust as shown by a to the exterior of the housing portion 211 and the generation of suction power as shown by A by operation the air current generation portion 215. By the suction power, the transfer material S with the toner image transferred thereto is held on the suction face 212 against the force of gravity. The suction power is the extent of making the transfer material S to be held on the suction face 212, but not the extent of impeding the advance of the transfer material S against the force of making the transfer material S to be pushed out from the secondary transfer nip.

The transfer material transporting device 230 is generally constituted by the housing portion 231 with the air current generation portion 235, such as a sirocco fan, mounted, the transfer material transporting members 250 disposed around the housing portion 231, and so on. In the transfer material transporting device 230, a configuration is made such that exhaust from a space R2 in the housing portion 231 to the exterior of the housing portion 231 can be performed by the air current generation portion 235.

The lower face side of the housing portion 231 constitutes the suction face 232 provided in its one surface with a plurality of venting holes, and in accordance with the exhaust operation b of the air current generation portion 235, suction power as shown by B is generated in the suction face 232. At this time, by the action of the partition wall members 233 provided in the housing portion 231, the exhaust from the space R2 in the housing portion 231 is relatively equally performed, and also in the suction power in the suction face 232, a bias does not occur with location.

The transfer material transporting member 250 disposed around the housing portion 231 is an endless belt provided with a plurality venting holes (not shown) which penetrate from one side main surface to the other side main surface, and is mounted in a tensioned state on the transfer material transporting member driving roller 251, which provides driving force to the transfer material transporting member 250, and the transfer material transporting member mounting rollers 252 and 253. The transfer material transporting member 250 moves in a direction of an arrow in the drawing by the rotation of the transfer material transporting member driving roller 251, and the movement speed thereof is approximately the same extent as the speed of the image forming process. The length (width of the transfer material transporting member 250) in the axial direction of the transfer material transporting member 250 is constituted to be longer than the width of the transfer material having a largest width which the image forming apparatus can deal with.

The suction power in the suction face 232 of the housing portion 231 acts also from the venting holes of the transfer material transporting member 250, so that the transfer material S with the toner image transferred thereto is held on a transport face P of the transfer material transporting member 250 against the force of gravity, and also, transported on the transport face P in accordance with the movement of the transfer material transporting member 250 by the driving force of the transfer material transporting member driving roller 251. The region of the transfer material transporting member 250 between the transfer material transporting member mounting rollers 252 and the transfer material transporting member driving roller 251 is used as the transport face P which transports the transfer material S.

The second suction device 270 has the housing portion 271 with the air current generation portion 275, such as a sirocco fan, mounted, and exhaust from a space R3 in the housing portion 271 to the exterior of the housing portion 271 is performed by the air current generation portion 275. The lower face side of the housing portion 271 constitutes the suction face 272 provided in its one surface with a plurality of venting holes, and suction power as shown by C can be generated by the exhaust operation c of the air current generation portion 275 of the second suction device 270. By the suction power, the transfer material S with the toner image transferred thereto is held on the suction face 272 against the force of gravity. The suction power is the extent of making the transfer material S to be held on the suction face 272, but is not large to the extent of impeding the transportation of the transfer material S against the force involved in the transportation of the transfer material S.

A transfer material transport section of this embodiment, which is constituted by the first suction device 210, the transfer material transporting device 230, the second suction device 270, and so on transports the transfer material with the face of the transfer material with the toner image transferred thereto, located on the vertically lower side.

The blower 400 is for discharging air a space between the transfer belt 40 and the secondary transfer roller 61 in the vicinity of an outlet of the secondary transfer nip and is constituted such that air is fed into a space R4 in the housing portion 401 by the air current generation portion 405, such as a sirocco fan. In the housing portion 401, the opening portion 402 extending over the axial direction of a class of rollers is provided, and air fed into the housing portion 401 in accordance with the air current generating operation d of the air current generation portion 405 is discharged as shown by D from the opening portion 402. The discharge power of air at this time is adjusted to the extent of preventing the transfer material S with the toner image transferred thereto from drooping due to the force of gravity and the extent of preventing the transfer material S from flapping due to the impetus of air.

Next, the operation of the transfer material transport section in the embodiment constituted as described above is explained. FIG. 16 shows a state immediately after the leading end portion ($S_o$) in the transport direction of the transfer material S has been discharged from the secondary transfer nip of the secondary transfer unit 60, that is, immediately after the transfer material S has been delivered from the secondary transfer unit 60 side to the transport section. The transfer material S is transported sliding on the suction face 212 by the force of the feeding operation from the secondary transfer unit 60 side while being held on the suction face 212 without dropping, by the suction power A of the suction face 212, which is generated in accordance with the operation a of the air current generation portion 215, as shown in the drawing. At this time, since the face of the transfer material S, which is adsorbed on the suction face 212, is a face on which the toner image is not formed by the previous secondary transfer operation, an event does not occur that an un-fixed toner image is disturbed in accordance with the transportation operation by the transport section. Also, in this embodiment, since the first suction device 210 is provided, the discharge position of the transfer material S can be stably held, and consequently, the un-fixed toner image can be preventing from being disturbed due to the contact of the toner image formation face of the transfer material S with a member such as the transfer belt 40 which is located on the lower side in the direction of the force of gravity. Also, since the first suction device 210 which sucks the transfer material S is provided between the secondary transfer roller 61 and the transfer material transporting device 230, after the leading end of the transfer material has been separated from the belt or the transfer roller 61, it is possible to make the position of the transfer material to follow the suction of air, thereby stabilizing the position of the transfer material.

If the leading end portion in the transport direction of the transfer material S which is transported sliding on the suction face 212 of the first suction device 210 by the force of the feeding operation from the secondary transfer unit 60 side reaches the transfer material transporting device 230 side, then, the transfer material S is held by the suction power B in the transport face P of the transfer material transporting member 250, and also, advances toward the fixing unit 90 on the transport face P in accordance with the movement operation of the transfer material transporting member 250.

FIG. 16 is to show a state immediately after the rear end portion ($S_E$) in the transport direction of the transfer material S has been discharged from the secondary transfer nip of the secondary transfer unit 60. In particular, at this time, by discharging air, as shown by D, by the operation of the blower 400, the image can be prevented from being damaged due to the contact of the rear end portion ($S_E$) of the transfer material with the transfer belt 40, etc. when the rear end portion ($S_E$) of the transfer material S has been discharged from the secondary transfer nip.

In this embodiment, since the blower 400 is provided which discharges air to the nip outlet space between the secondary transfer roller 61 and the transfer belt 40, as described above, the rear end portion ($S_E$) of the transfer material can be pushed against the secondary transfer roller 61 side also after it has been discharged from the secondary transfer nip, so that the position of the transfer material S after discharge from the secondary transfer nip can be stabilized.

The transfer material S shown in FIG. 16 is a transfer material being longest when viewed from the transport direction, which the apparatus can deal with. In the image forming apparatus of the invention, the dimension of each configuration is determined such that even if a longest transfer material is used, s state is obtained in which the transfer material S is not caught in any of the fixing nip of the fixing unit 90 and the secondary transfer nip of the secondary transfer unit 60. Therefore, even if there is a difference in speed of transporting the transfer material S between the fixing unit 90 and the secondary transfer unit 60, slack or drag does not occur in the transfer material S, so that adverse effects on the image, etc can be avoided.

Also, when the transfer material S is transported on the transport face P of the transfer material transporting device 230 in a state where the transfer material is caught in the secondary transfer nip of the secondary transfer unit 60, even if there is a difference between the transport speed of the secondary transfer unit 60 and the transport speed of the transfer material transporting member 250, since the transfer material S held by the transfer material transporting member 250 is held only by the suction power by air, the transfer material can slide on the transfer material transporting member 250, so that slack, drag, or the like does not occur in the transfer material S.

Similarly, when the transfer material S is transported on the transport face P of the transfer material transporting device 230 in a state where the transfer material is caught in the fixing nip of the fixing unit 90, even if there is a difference between the transport speed of the fixing unit 90 and the transport speed of the transfer material transporting member 250, the transfer material can slide on the transfer material transporting member 250, so that slack, drag, or the like does not occur in the transfer material S.

As viewed in the aforementioned, the transfer material transporting device 230 can function as a mechanism of taking in a difference in the transport speed of the transfer material S in each unit.

The transfer material S transported on the transport face P of the transfer material transporting device 230 enters into the fixing nip, which is formed by the heating roller 91 and the pressurizing roller 92 in the fixing unit 90, via the suction face 272 of the second suction device 270. In the transfer material S passed through the fixing nip, the toner image is fused and bonded, thereby becoming a permanent visible image.

In an image forming method using a liquid developer, there is a case where a phenomenon occurs that when keeping a given period of time after the secondary transfer at the secondary transfer unit 60, an excellent fixing efficiency can be obtained in the fixing unit 90. This is because that by keeping a given period of time, it is possible to infiltrate a carrier, which impedes the fixing, into the transfer material S. If a layout is taken in which the fixing unit 90 is provided immediately after the secondary transfer unit 60, there is a fear that a fixing efficiency will be lowered due to the fact that the transfer material S is subjected to toner transfer by the secondary transfer unit 60 and soon fixed. However, according to the image forming apparatus concerning the invention, since a layout is adopted in which the transport section constituted by the first suction device 210, the transfer material transporting device 230, the second suction device 270, etc. exists between the secondary transfer unit 60 and the fixing unit 90, it is possible to get a given period of time after the secondary transfer until the fixing by a time involved in the transportation of the transfer material S, so that an excellent fixing efficiency can be obtained in the fixing unit 90.

Also, according to the image forming apparatus concerning the invention, since the first suction device 210 which sucks the transfer material S discharged from the secondary transfer unit 60 is provided, the transfer material S after the secondary transfer can be discharged to a space above the transfer belt 40, so that it is possible to dispose the fixing unit 90 by using the space. Therefore, an effect of being able to reduce the installation face of the apparatus is also obtained.

Figure 17:
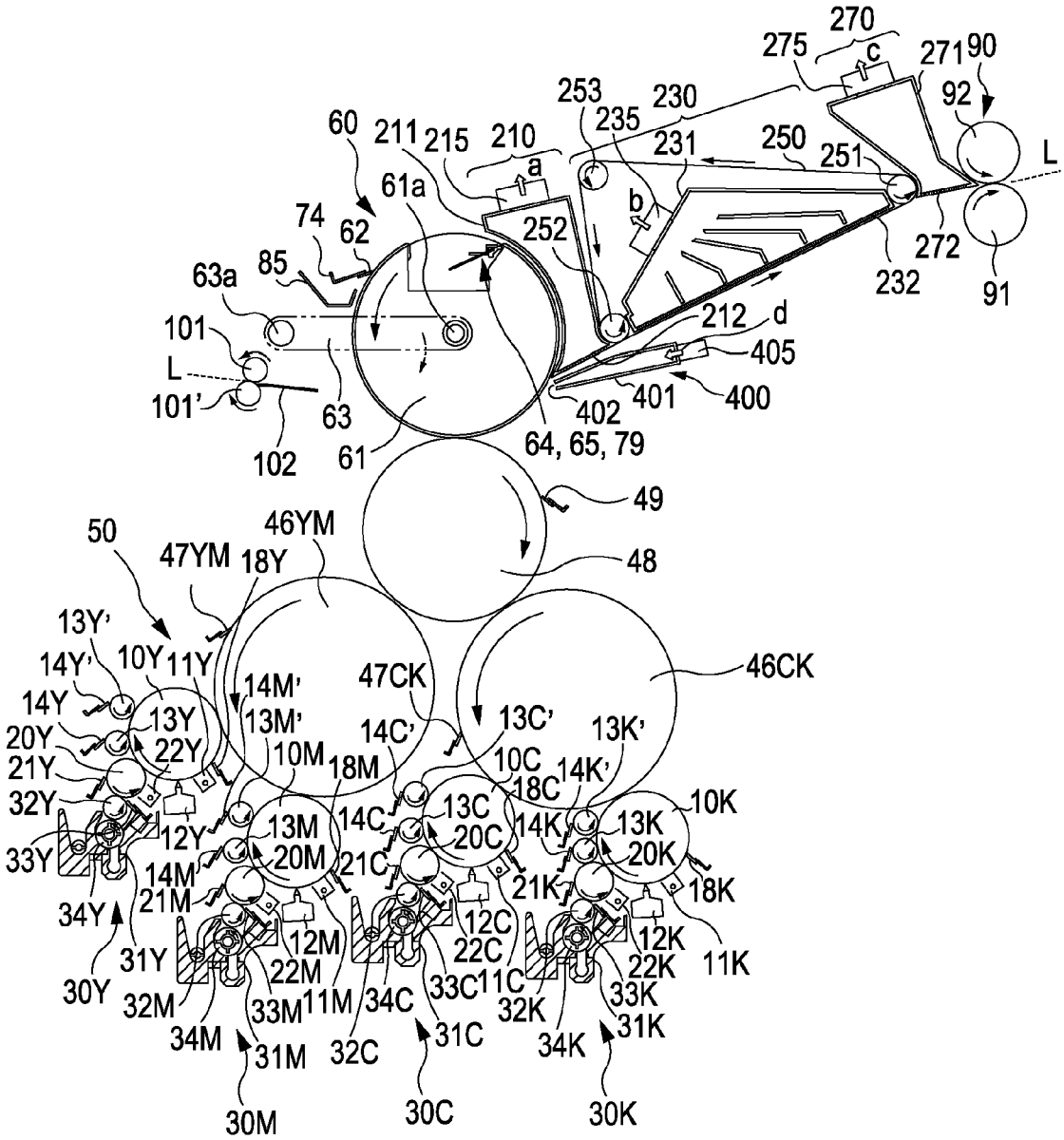
FIG. 17 is a view showing principal components constituting an image forming apparatus concerning another embodiment of the invention.

FIG. 17 is a view showing principal components constituting an image forming apparatus concerning a second embodiment of the invention. The image forming apparatus of the second embodiment is to use a first intermediate transfer drum 46YM, a second intermediate transfer drum 46CK, and a third intermediate transfer drum 48, as transfer media.

The first intermediate transfer drum 46YM, the second intermediate transfer drum 46CK, and the third intermediate transfer drum 48 are each constituted by a main body portion made of electrically-conductive metal and a seamless rubber layer formed on the main body portion. The first intermediate transfer drum 46YM comes into contact with photoconductors 10Y and 10M, and the second intermediate transfer drum 46CK comes into contact with photoconductors 10C and 10K. In the first intermediate transfer drum 46YM, the contact positions with the photoconductors 10Y and 10M become transfer positions, so that the developed toner images on the photoconductors 10Y and 10M are transferred in sequence with layers to form a toner image, and in the second intermediate transfer drum 46CK, the contact positions with the photoconductors 10C and 10K become transfer positions, so that the developed toner images on the photoconductors 10C and 10K are transferred in sequence with layers to form a toner image. In the third intermediate transfer drum 48, the contact position with the first intermediate transfer drum 46YM becomes a transfer position, so that the toner image of the first intermediate transfer drum 46YM is transferred thereto, and the contact position with the second intermediate transfer drum 46CK becomes a transfer position, so that the toner image of the second intermediate transfer drum 46CK is transferred thereto. The toner image supported on the third intermediate transfer drum 48 is transferred to a transfer material S, which is transported and entered, by a transfer section 60. The transfer section 60 has a transfer roller 61 as a transfer member. The transfer roller 61 is the same as the secondary transfer roller used in the first embodiment.

Also, a first intermediate transfer drum cleaning blade 47YM which cleans the first intermediate transfer drum 46YM comes into contact with the first intermediate transfer drum 46YM. The contact position of the first intermediate transfer drum cleaning blade 47YM exists after the contact of the first intermediate transfer drum with the third intermediate transfer drum 48 and before the contact of the first intermediate transfer drum with the photoconductors 10Y and 10M. Similarly, a second intermediate transfer drum cleaning blade 47CK which cleans the second intermediate transfer drum 46CK comes into contact with the second intermediate transfer drum 46CK. The contact position of the second intermediate transfer drum cleaning blade 47CK exists after the contact of the second intermediate transfer drum with the third intermediate transfer drum 48 and before the contact of the second intermediate transfer drum with the photoconductors 10C and 10K. Further, a third intermediate transfer drum cleaning blade 49 which cleans the third intermediate transfer drum 48 comes into contact with the third intermediate transfer drum 48. The contact position of the third intermediate transfer drum cleaning blade 49 exists after the contact of the third intermediate transfer drum with the transfer roller 61 and before the contact of the third intermediate transfer drum with the first intermediate transfer drum 46YM and the second intermediate transfer drum 46CK.

Since other configurations are the same as the embodiment shown in FIG. 1, explanation is omitted. In addition, although in this specification, various embodiments have been explained, the invention can also be applied to, for example, an image forming apparatus which directly transfers a toner image on a photoconductor to a transfer material, and an embodiment configured by appropriately combining the configurations of the respective embodiments is also to be included in a category of the invention.

The entire disclosure of Japanese Patent Application No: 2009-50683, filed Mar. 4, 2009 is expressly incorporated by reference herein.

What is claimed is:

1. A transfer device comprising:

an electrically-conductive elastic member that carries a transfer material;

a transfer material separating member that separates the transfer material from the elastic member, the transfer material separating member being part of a gripping mechanism that comprises a transfer gripping member, a gripping portion, and a gripping portion bearing portion, the transfer material portion being disposed adjacent the gripping portion;

a supporting member that has an elastic member supporting portion that supports the elastic member, and a separating member supporting portion that supports the transfer material separating member, and has a electrically-conductive property; and a transfer bias applying section that is electrically connected to the supporting member, thereby applying a transfer bias.

2. The transfer device according to claim 1, further comprising:

an electrically-conductive flange disposed at an end portion of the supporting member; and a connection portion that electrically connects the transfer bias applying section and the flange.

3. The transfer device according to claim 1, wherein volume resistance of the elastic member is $1\times10^{6}$ to $1\times10^{11}$ Ωcm.

4. The transfer device according to claim 1, wherein the supporting member is a rotary circular cylinder member, the separating member supporting portion has a concave portion formed in the circular cylinder member, and the transfer material separating member is a projecting member that is projected from the concave portion.

5. The transfer device according to claim 1, wherein the transfer material separating member supporting portion and the elastic member supporting portion are constituted by an integral, electrically-conductive member, and the separating member supporting portion supports the transfer material separating member through an insulation material.

6. An image forming apparatus comprising:

an image carrier that carries a developed image;

a transfer section that has an electrically-conductive elastic member that carries a transfer material, a transfer material separating member that separates the transfer material from the elastic member, the transfer material separating member being part of a gripping mechanism that comprises a transfer gripping member, a gripping portion, and a gripping portion bearing portion, the transfer material portion being disposed adjacent the gripping portion, and a supporting member that has an elastic member supporting portion that supports the elastic member, and a separating member supporting portion that supports the transfer material separating member, and has electrically-conductive properties;

a transfer bias applying section that is electrically connected to the supporting member, thereby applying a transfer bias;

a transfer material transport section that transports the transfer material to which the image is transferred by the transfer section; and a fixing section that fixes the image transferred to the transfer material.

7. The image forming apparatus according to claim 6, wherein the image carrier is a belt member tensioned around a tension roller.

8. The image forming apparatus according to claim 6, wherein the image carrier is a rotary drum.

* * * * *